United States Patent [19]

Cejka

[11] 4,048,638

[45] Sept. 13, 1977

[54] ANTENNA LENGTH INDICATOR

[75] Inventor: Joseph B. Cejka, Fair Haven, N.J.

[73] Assignee: Ward Products Corporation, New Brunswick, N.J.

[21] Appl. No.: 641,034

[22] Filed: Dec. 15, 1975

[51] Int. Cl.[2] ..... H01Q 1/10

[52] U.S. Cl. ..... 343/894; 343/901

[58] Field of Search ..... 343/723, 823, 894, 901, 343/715

[56] References Cited

U.S. PATENT DOCUMENTS 3,852,757 12/1974 Kaiser ..... 343/901

FOREIGN PATENT DOCUMENTS 1,155,271 11/1957 France ..... 343/723

*Primary Examiner*—Eli Lieberman

*Attorney, Agent, or Firm*—James F. Lesniak

[57] ABSTRACT

A telescoping antenna with an indicator on a moveable telescoping antenna section which indicates the degree of telescopic movement of the moveable telescoping antenna section which is necessary to achieve a predetermined overall extended antenna length.

5 Claims, 4 Drawing Figures

ANTENNA LENGTH INDICATOR

BACKGROUND OF THE INVENTION

This invention relates to telescoping antennas, and more particularly to a telescoping antenna having an indicator which indicates the degree of telescoping necessary to achieve a predetermined antenna length.

Telescoping antennas have been in wide use for many years for signal reception and transmission to radios, televisions and the like. One of the most widespread uses for telescoping antennas has been on vehicles as vehicle radios became a common vehicle accessory. In years past vehicle radios were generally AM radios and thus the longer the telescoping capability of the antenna the better the radio reception, especially of distant signal broadcasts. However, in recent years the AM-FM radio unit has gained increasing popularity. Unlike the case with AM reception where any increase in antenna length generally improves the strength of signal pick-up because of the short AM wavelengths, the relatively long FM wavelengths on the order of 124 inches require incremental increases in length to improve reception without distortion, such as in quarter, half, or full wavelength increments. In the case of the FM band frequencies employed in home and vehicle FM radios, the mean quarter wavelength is approximately 31 inches. Thus, optimum antenna lengths for this FM reception range would be approximately 31, 62, 93, 124 inches, etc.

Because of many problems inherent in unduly long antennas on moving vehicles, e.g. strength, overhead obstructions, etc., aside from special applications, the vehicle antenna industry has generally standardized on antennas with extended lengths less than 60 inches. Thus, the goal in antennas for optimum FM reception has been an extended length of approximately 31 inches. In fact, one of the more widely used type of vehicle antenna today has a non-telescoping antenna mast with a fixed length of 31 inches. This type of antenna optimizes FM reception while yielding acceptable AM performance where the AM broadcast signals are relatively strong.

Nevertheless, there still exists a strong market for telescoping antennas which achieve antenna lengths greater than 31 inches to enhance reception of weaker AM broadcast signals. Furthermore, it is desirable that telescoping antennas be capable of telescoping to less than 31 inches to minimize bending and breaking problems in car washes, etc., to which telescoping antennas are susceptable. Thus, the ideal telescoping antenna today would be one which has an extended length greater than 31 inches and a collapsed length less than 31 inches, but one which can also be easily and conveniently set at a length of 31 inches to optimize the FM reception.

SUMMARY OF THE INVENTION

According to the present invention there is provided a telescoping antenna having at least one moveable telescoping antenna section which telescopes in and out of an adjacent antenna section. An indicator is provided on the moveable antenna section which indicates the degree of telescopic movement of the moveable antenna section which is necessary to achieve a predetermined overall extended antenna length. Preferably the indicator is a slidable cylindrical sleeve around the moveable antenna section which is slidable between the upper end of the moveable antenna section and an indicator stop on the moveable antenna section below its upper end. The indicator stop is positioned so that when the moveable antenna section is telescoped into the adjacent antenna section until the indicator sleeve is against the stop and immediately adjacent the upper end of the adjacent antenna section a predetermined overall extended antenna length will be achieved, preferably 31 inches when the antenna is used with FM radios. Further, the indicator stop is preferably sized so that it can pass into the adjacent antenna section when the moveable antenna section is telescoped therein to the fully collapsed position with the indicator sleeve slid to the upper end of the moveable antenna section to achieve a collapsed overall antenna length less than the predetermined length.

DESCRIPTION OF THE PREFERRED EMBODIMENTS

Figure 1:
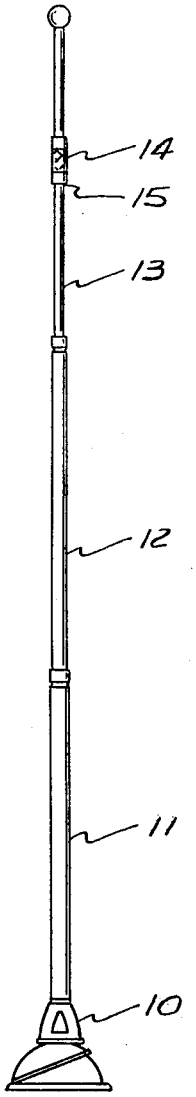
FIG. 1 is an elevational view of the antenna of the present in the fully extended position.

Referring now to the drawings in more detail, FIG. 1 shows a three section telescoping antenna which includes base assembly 10 for mounting the antenna to a vehicle fender, a fixed cylindrical antenna section 11, a first cylindrical moveable telescoping antenna section 12 which telescopes in and out of the adjacent fixed section 11, and a second cylindrical moveable telescoping antenna section 13 which telescopes in and out of the adjacent antenna section 12. As shown in FIG. 1, the antenna is fully extended.

Figure 2:
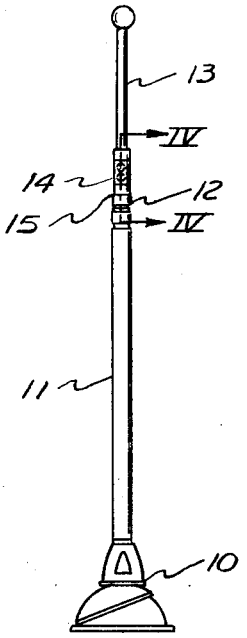
FIG. 2 is an elevational view of the antenna of the present invention telescoped to a predetermined length.
Figure 4:
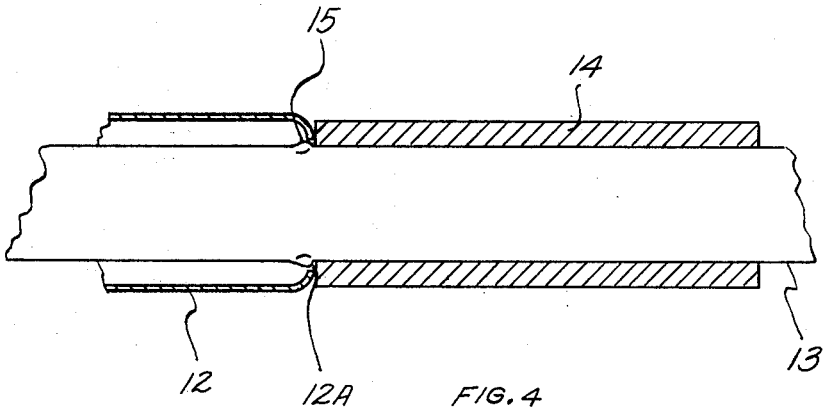
FIG. 4 is a cross sectional view of the length indicator of the antenna of the present invention taken along the line IV—IV of FIG. 2.

Around section 13 is mounted a slidable indicator sleeve 14 which is slidable between the upper end of section 13 and an indicator stop 15 (See FIG. 4). Indicator stop 15 is located on the length of section 13 at a point so that when section 12 is fully telescoped into section 11 and section 13 is telescoped into section 12 until indicator 14 and stop 15 are at the upper end of section 12 (See FIG. 2), a predetermined overall extended antenna length will be achieved. For example, in the case of antennas for use with vehicle FM radios, the predetermined overall extended length as shown in FIG. 2 would be 31 inches, the mean quarter wavelength for the FM frequencies used in such radios.

Figure 3:
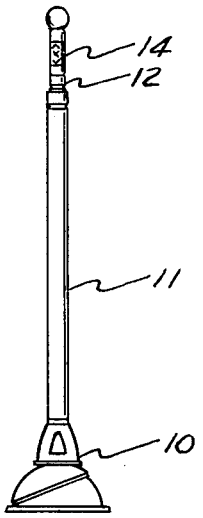
FIG. 3 is an elevational view of the antenna of the present invention in the fully collapsed position.

The relationship between indicator sleeve 14, stop 15, section 13 and section 12 is most clearly shown in FIG. 4. As shown in FIG. 4, indicator stop 15 comprises a pair of wings formed outwardly by crimping the material of section 13 around its periphery at the predetermined location along its length. It should be understood, however, that while this is a preferred method of forming the indicator stop, other methods can be used, e.g., welding or otherwise affixing a peripheral stop ring, etc., to section 13 and the like, the object being to form an enlarged portion around the periphery of section 13 to function as an indicator stop. The important parameters of stop 15 are that it create a transverse dimension at a predetermined location in section 13 greater than the inside diameter of sleeve 14 but less than the inside diameter of the upper end 12A of section 12. This is so that indicator stop 15 will function to stop indicator 14 but also will not prevent section 13 from being fully telescoped into section 12 when it is desired to totally collapse the antenna as shown in FIG. 3.

In use, the antenna of the present invention may be extended and collapsed from fully extended to fully collapsed like conventional telescoping antennas when a predetermined length is not needed nor desired. However, when the operator desires the antenna length to be set at a predetermined length, for example to optimize FM reception, he can easily and without any visual inspection set the antenna at the predetermined length. When the antenna is in an extended position such as in FIG. 1, the operator merely grasps indicator 14 and applies a downward force until the downward telescoping movement ceases. The antenna will then always be in the predetermined length position shown in FIG. 2. When starting with the antenna in the fully collapsed position (FIG. 3), the operator extends section 13 until indicator 14 begins to move upwardly which will indicate that the antenna is in the predetermined extended length position. Thus, even in the dark of night, the antenna of the present invention can be easily set at its predetermined length since no visual adjustments or readings are necessary.

While the preferred embodiment of the present invention has been described and illustrated, it will be obvious to those skilled in the art that various changes and modifications can be made without departing from the spirit of the present invention. For example, while a three section antenna has been illustrated, any number of antenna sections can be employed. Also, while a predetermined length of 31 inches has been discussed for optimizing FM reception, the antenna of the present invention can be constructed to achieve any predetermined length. Thus, the scope of the present invention is deemed to be limited only by the claims.

The embodiments of the invention in which an exclusive property or privilege is claimed are defined as follows:

1. In a telescoping antenna having at least one moveable telescoping antenna section which telescopes in and out of an adjacent antenna section for substantially the entire length thereof, the improvement which comprises an indicator on said moveable antenna section which indicates the degree of telescopic movement of said moveable antenna section which is necessary to achieve a predetermined overall extended antenna length, wherein said indicator comprises a sleeve around said moveable antenna section which is freely slidable between the upper end of said moveable antenna section and a sleeve stop provided by an enlargement on said moveable antenna section below said upper end whereby when said sleeve is positioned at said stop and said moveable antenna section is telescoped into said adjacent antenna section so that said sleeve is immediately adjacent the upper end of said adjacent antenna section, said predetermined overall extended antenna length will be achieved.

2. A telescoping antenna according to claim 1 wherein said sleeve stop is smaller than the inside transverse dimension of said adjacent antenna section whereby said moveable antenna section can be substantially completely telescoped into said adjacent antenna section to achieve an overall extended length less than said predetermined length.

3. A telescoping antenna according to claim 2 wherein said predetermined extended antenna length is about 31 inches.

4. A telescoping antenna comprising a fixed cylindrical antenna section; at least one moveable cylindrical telescoping antenna section which can be telescopically moved in and out of an adjacent cylindrical antenna section to adjust the overall extended antenna length to a predetermined length, to a length greater than said predetermined length and to a length less than said predetermined length; and an indicator and indicator stop on said moveable antenna section, said indicator comprising a freely slidable cylindrical sleeve around said moveable antenna section having an outside diameter greater than and in inside diameter less than the inside diameter of the upper end of said adjacent cylindrical antenna section, said sleeve being slidable between said indicator stop and the upper end of said moveable antenna section, and said indicator stop comprising an enlarged portion on said moveable antenna section having a transverse dimension greater than the inside diameter of said sleeve and less than the inside diameter of said upper end of said adjacent antenna section and postioned at a predetermined location on said moveable antenna section whereby when said antenna is telescopically collapsed by exerting a downward force on said sleeve until said sleeve abuts said indicator stop and the upper end of said adjacent antenna section and any moveable antenna sections below said moveable section are fully collapsed, said predetermined extended length of said antenna will be achieved.

5. A telescoping antenna according to claim 4 wherein said predetermined extended antenna length is about 31 inches.

* * * * *